US011516564B2

(12) United States Patent
Lin

(10) Patent No.: US 11,516,564 B2
(45) Date of Patent: Nov. 29, 2022

(54) SPEAKER

(71) Applicant: ASUSTeK COMPUTER INC., Taipei (TW)

(72) Inventor: Wen-Hung Lin, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 53 days.

(21) Appl. No.: 16/893,632

(22) Filed: Jun. 5, 2020

(65) Prior Publication Data

US 2020/0404402 A1 Dec. 24, 2020

(30) Foreign Application Priority Data

Jun. 18, 2019 (TW) ..... 108121131

(51) Int. Cl.
*H04R 1/02* (2006.01)

(52) U.S. Cl.
CPC ..... *H04R 1/02* (2013.01)

(58) Field of Classification Search
CPC ..... H04R 1/00; H04R 9/022; F28D 15/02; F01N 1/065
USPC ..... 381/337, 338, 339, 340, 345, 164, 373, 381/382, 384, 386, 387, 395, 189, 397, 381/346, 348, 349, 162, 344, 354; 181/156, 147, 152, 199
See application file for complete search history.

(56) References Cited

U.S. PATENT DOCUMENTS 4,210,778 A * 7/1980 Sakurai ..... F28D 15/0266 381/349
4,230,907 A 10/1980 Hasselbach et al.
4,811,403 A * 3/1989 Henricksen ..... H04R 1/02 381/87
5,550,334 A * 8/1996 Langley ..... F16L 55/0333 381/71.7
6,654,472 B1 * 11/2003 Jeon ..... H04R 1/2826 381/349
7,940,951 B2 5/2011 Chen et al.
8,325,477 B2 12/2012 Ishikawa et al.
10,419,835 B2 9/2019 Zhang et al.
(Continued)

FOREIGN PATENT DOCUMENTS

CN 101370374 A * 2/2009
CN 101370374 A 2/2009
(Continued)

*Primary Examiner* — Alexander Krzystan
*Assistant Examiner* — Julie X Dang
(74) *Attorney, Agent, or Firm* — McClure, Qualey & Rodack, LLP

(57) ABSTRACT

A speaker includes a sound box, a speaker module, and a heat pipe. The sound box includes a first opening and a second opening. The speaker module is hermetically connected to the first opening. The heat pipe is hermetically connected to the second opening. The heat pipe includes a first end and a second end. The first end is located in the sound box. The second end is exposed to the second opening. The speaker module is fixedly connected to at least part of an outer wall of the heat pipe. In the speaker, a hollow heat pipe is fixedly connected to the speaker module, and vibration of the speaker module drives air in the heat pipe to flow to dissipate heat from the heat pipe. Further, the cold heat pipe carries heat away from the speaker module through heat transfer, thereby dissipating heat from the speaker.

5 Claims, 7 Drawing Sheets

(56) References Cited

U.S. PATENT DOCUMENTS

| | | | | |
|---|---|---|---|---|
| 2004/0208336 | A1* | 10/2004 | Hamada | H04R 1/025 381/386 |
| 2005/0169494 | A1* | 8/2005 | Stiles | H04R 1/02 381/337 |
| 2009/0086416 | A1 | 4/2009 | Ishikawa et al. | |
| 2016/0337756 | A1* | 11/2016 | Oliveira | H04R 3/007 |
| 2019/0253803 | A1* | 8/2019 | Davis | H04R 1/025 |

FOREIGN PATENT DOCUMENTS

| | | | |
|---|---|---|---|
| CN | 203149475 | U | 8/2013 |
| CN | 105806131 | A | 7/2016 |
| CN | 205693882 | U | 11/2016 |
| CN | 106792335 | A | 5/2017 |
| CN | 207304917 | U | 5/2018 |
| CN | 208863065 | U | 5/2019 |
| TW | M278215 | U | 10/2005 |
| TW | I328735 | B | 8/2010 |

* cited by examiner

SPEAKER

CROSS-REFERENCE TO RELATED APPLICATION

This application claims the priority benefit of Taiwan application serial No. 108121131 filed on Jun. 18, 2019. The entirety of the above-mentioned patent application is hereby incorporated by reference herein and made a part of specification.

BACKGROUND OF THE INVENTION

Field of the Invention

The disclosure relates to a speaker, and in particular, to a speaker including a heat dissipation structure.

Description of the Related Art

With the rapid development of electronic technologies, there are various types of multimedia electronic devices such as notebooks, personal computers (PCs), mobile phones, and personal digital assistants (PDAs). As people receive information from the outside world mainly via visual sense and auditory sense, such multimedia electronic devices—a display or a speaker—are equipped with electronic devices to provide visual and audio information to users.

However, as multimedia electronic devices are developing toward a lightweight and thin structure, the volume for occupying a speaker and the space for heat dissipation of a speaker become smaller. Consequently, a large amount of heat accumulates during the continuous operation of the speaker would damage it.

BRIEF SUMMARY OF THE INVENTION

According to an aspect, a speaker is provided. The speaker includes a sound box, a speaker module, and a heat pipe. The sound box includes a first opening and a second opening. The speaker module is hermetically connected to the first opening. The heat pipe is hermetically connected to the second opening. The heat pipe includes a first end and a second end. The first end is located in the sound box and is fixedly connected to the speaker module. The second end is exposed to the second opening. The speaker module is fixedly connected to at least part of an outer wall of the heat pipe.

Based on the above, in the speaker of the disclosure, a hollow heat pipe is fixedly connected to the speaker module, and vibration of the speaker module drives air in the heat pipe to flow to dissipate heat from the heat pipe. Further, the cold heat pipe carries heat away from the speaker module through heat transfer, thereby dissipating heat from the speaker.

These and other features, aspects and advantages of the present invention will become better understood with regard to the following description, appended claims, and accompanying drawings.

DETAILED DESCRIPTION OF THE EMBODIMENTS

Figure 1:
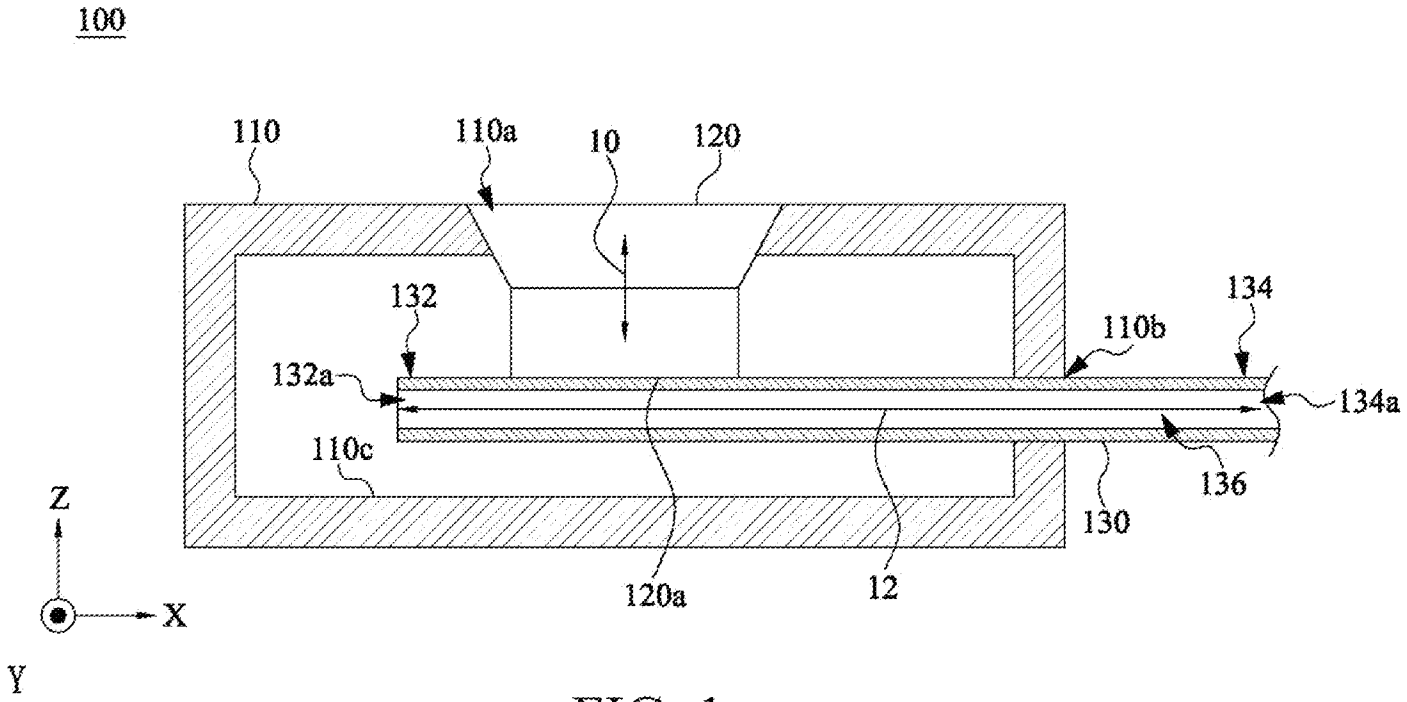
FIG. 1 is a cross-sectional view of a speaker according to an embodiment of the disclosure.

Various embodiments of the disclosure will be disclosed in the accompanying drawings, and for purposes of clarity of illustration, numerous practical details will be set forth in the following description. However, it should be understood that these practical details are not intended to limit the disclosure. That is, in some embodiments of the disclosure, such practical details are unnecessary. In addition, some well-known and customary structures and elements will be shown in the drawings in a simple schematic manner for the sake of simplifying the drawings. The drawings are for illustrative purposes only and are not drawn to the original dimensions.

FIG. 1 is a cross-sectional view of a speaker 100 according to an embodiment of the disclosure. As shown in FIG. 1, in an embodiment, the speaker 100 of the multimedia electronic device provides sound information to a user. In an embodiment, the multimedia electronic device is a notebook, a personal computer (PC), a mobile phone, a personal digital assistant (PDA), or the like. In another embodiment, the speaker 100 is used independently as an acoustics, a loudspeaker, or other electronic device configured to convert an electronic signal into a sound and broadcast the sound.

The speaker includes a sound box 110, a speaker module 120, and a heat pipe 130. The sound box 110 is a hollow shell, and includes a first opening 110*a* and a second opening 110*b*. In an embodiment, the first opening 110*a* and the second opening 110*b* are respectively located on two adjacent walls of the sound box 110. In an embodiment, the first opening 110*a* and the second opening 110*b* are located on the same wall of the sound box 110. In an embodiment, the first opening 110*a* and the second opening 110*b* are located on two opposite walls of the sound box 110. In other words, the positions of the first opening 110*a* and the second opening 110*b* are flexibly adjusted according to actual situations, and the disclosure is not limited to that shown in FIG. 1.

The speaker module 120 is configured to vibrate to generate a sound. The speaker module 120 is hermetically connected to the first opening 110*a* of the sound box 110. The heat pipe 130 is in contact with the speaker module 120, and is hermetically connected to the second opening 110*b* of the sound box 110. Specifically, the heat pipe 130 includes a first end 132 and a second end 134. The heat pipe 130 extends from the position at which the heat pipe 130 is connected to the second opening 110*b*. The first end 132 of the heat pipe 130 is located inside the sound box 110, and the second end 134 of the heat pipe 130 is located outside the sound box 110. Specifically, the second end 134 of the heat pipe 130 is exposed through the second opening 110*b* of the sound box 110. A pipe wall of the heat pipe 130 located below the speaker module 120 directly or indirectly contacts a bottom surface 120*a* of the speaker module 120.

The heat pipe 130 further includes a first pipe opening 132*a*, a second pipe opening 134*a*, and a channel 136. The first pipe opening 132*a* is formed on the first end 132 of the heat pipe 130. The second pipe opening 134*a* is formed on the second end 134 of the heat pipe 130. The channel 136 is connected with the first pipe opening 132*a* and the second pipe opening 134*a*. Since the speaker module 120 and the heat pipe 130 are respectively hermetically connected to the first opening 110*a* and the second opening 110*b* of the sound box 110, air inside the sound box 110 is only in communication with the atmosphere outside the sound box 110 through the first pipe opening 132*a*, the channel 136, and the second pipe opening 134*a* of the heat pipe 130.

In practical, the length and the position of extension of the heat pipe 130 in the sound box 110 are flexibly adjusted according to actual situations. In other words, any configuration in which the heat pipe 130 is in contact with the speaker module 120 shall fall within the scope of the disclosure, and the disclosure is not limited to that shown in FIG. 1.

In some embodiments, the heat pipe 130 includes a metal. In an embodiment, the metal is copper, aluminum, or other thermally conductive material.

Through the above structural design, the heat pipe 130 is in contact with the speaker module 120, so that the heat pipe 130 quickly takes heat energy away from the speaker module 120 through heat transfer, thereby dissipating heat from the speaker module 120. Further, in a process of generating a sound, the speaker module 120 vibrates along a direction shown by an arrow 10, to increase or decrease the volume of the sound box 110. When the volume of the sound box 110 changes, air pressure inside the sound box 110 changes, and accordingly, an air flow is produced between the first pipe opening 132*a* and the second pipe opening 134*a* of the heat pipe 130. The air flow flows in the channel 136 of the heat pipe 130 in a direction shown by an arrow 12, to dissipate heat from the heat pipe 130 and lower the temperature of the heat pipe 130. When the heat pipe 130 is cooled by the air flow, the temperature difference between the heat pipe 130 and the speaker module 120 increases, and therefore the heat transfer between the heat pipe 130 and the speaker module 120 is further accelerated, thereby greatly improving the efficiency of the speaker module 120 in dissipating heat from the heat pipe 130.

Figure 2:
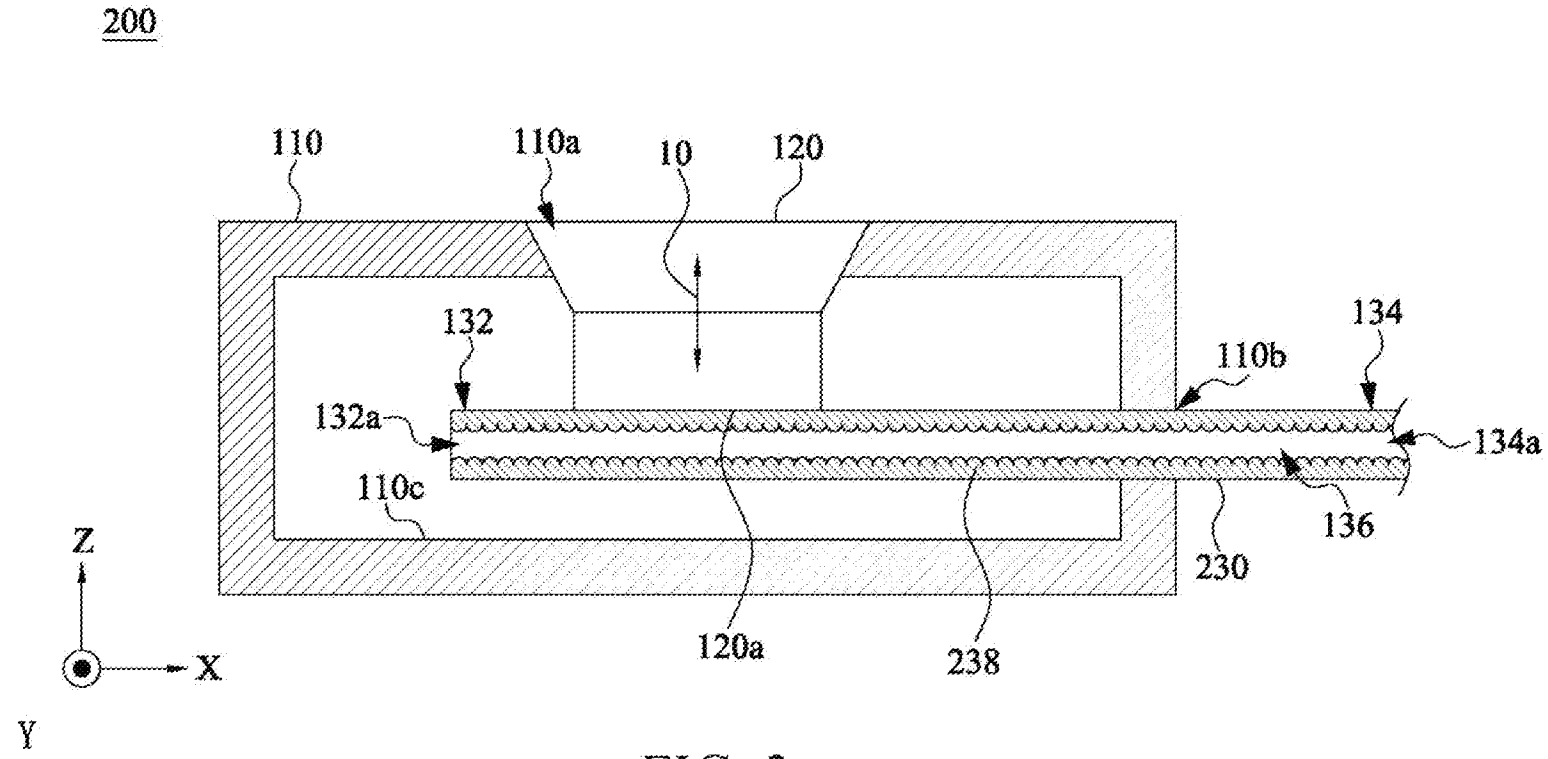
FIG. 2 is a cross-sectional view of a speaker according to an embodiment of the disclosure, where a microstructure is formed on a pipe wall.

FIG. 2 is a cross-sectional view of a speaker 200 according to another embodiment of the disclosure. As shown in FIG. 2, in this embodiment, the speaker 200 includes a sound box 110, a speaker module 120, and a heat pipe 230. In this embodiment, the sound box 110 and the speaker module 120 are as the same as those in the embodiment shown in FIG. 1. For details, refer to the foregoing related description, and the details will not be described herein again. In an embodiment shown in FIG. 2, the heat pipe 230 further includes a microstructure 238. The microstructure 238 is formed on an inner pipe wall of the heat pipe 230, making the surface of the inner pipe wall of the heat pipe 230 uneven. The microstructure 238 further includes a metal. In an embodiment, the metal is copper, aluminum, or other thermally conductive material. In some embodiments, the microstructure 238 is a grooved structure, a sintered metal, or a metal mesh.

In the embodiment shown in FIG. 2, the microstructure 238 increases the contact area between the heat pipe 230 and the air flow in the channel 136 to improve the heat dissipation efficiency of the heat pipe 230, thereby improving the heat dissipation effect of the heat pipe 230 for the speaker module 120. In addition, the microstructure 238 causes a turbulence in the channel 136, to slow down the flow rate of the air flow in the channel 136, thereby reducing noise generated when the air flow flows in the heat pipe 130, and improving the sound quality of the speaker 200.

Figure 3:
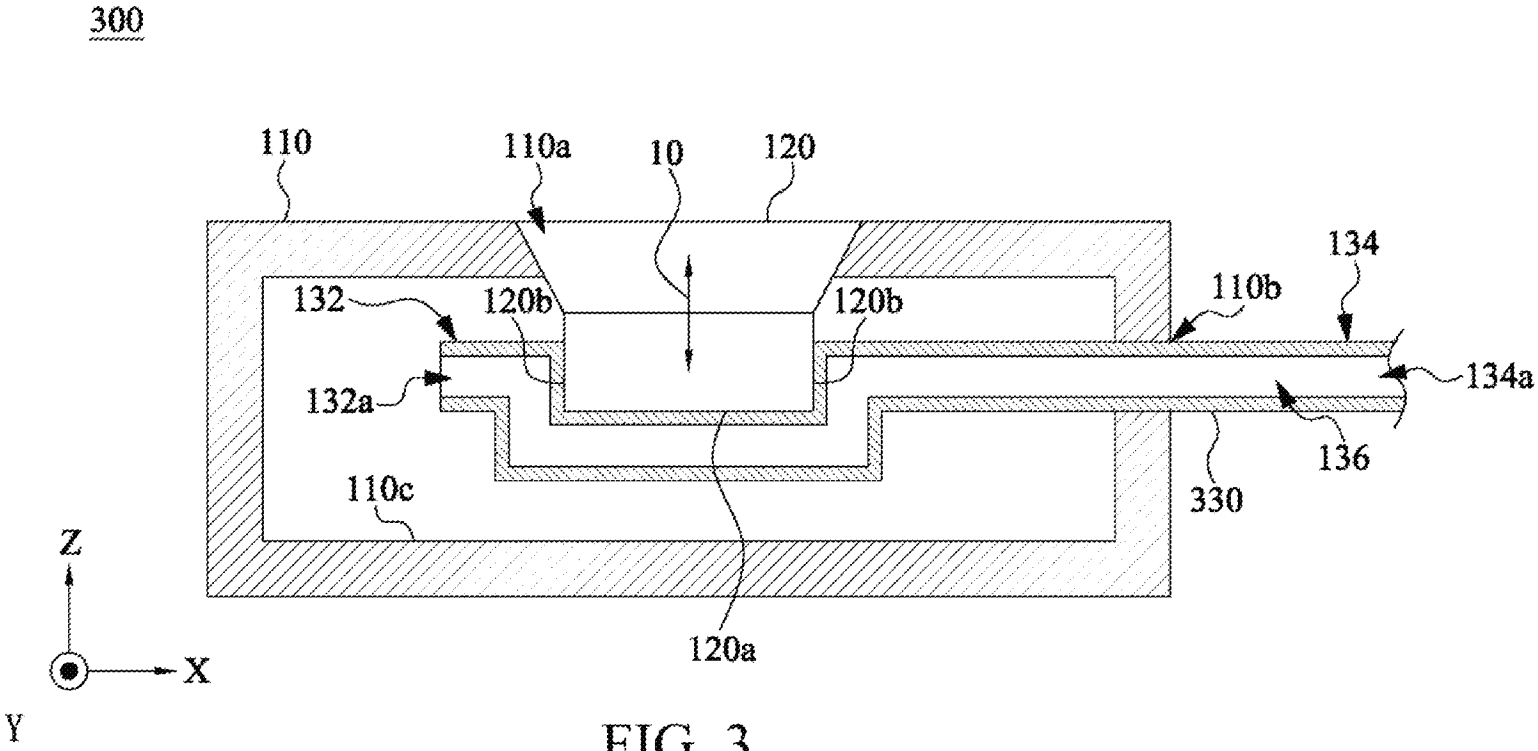
FIG. 3 is a cross-sectional view of a speaker according to an embodiment of the disclosure, where a heat pipe surrounds a speaker module.

FIG. 3 is a cross-sectional view of a speaker 300 according to another embodiment of the disclosure. As shown in FIG. 3, in this embodiment, the speaker 300 includes a sound box 110, a speaker module 120, and a heat pipe 330. In this embodiment, the sound box 110 and the speaker module 120 are as the same as those in the embodiment shown in FIG. 1. For details, refer to the foregoing related description, and the details will not be described herein again. In this embodiment shown in FIG. 3, the heat pipe 330 surrounds at least part of an outer wall of the speaker module 120, and contacts the outer wall of the speaker module 120. Specifically, a body of the heat pipe 330 is bent along the shape of the speaker module 120 to form a U-shape structure. Two sides of the U-shape structure directly contact two side walls 120*b* of the speaker module 120. The recessed part of the U-shape structure directly contacts the bottom surface 120*a* of the speaker module 120. In this way, the contact area for heat transfer between the heat pipe 30 and the speaker module 120 is increased, so that the heat dissipation effect of the heat pipe 330 for the speaker module 120 is improved.

In some embodiments, the heat pipe 330 helically surrounds the outer wall of the speaker module 120, and contacts the outer wall of the speaker module 120, and the disclosure is not limited to that shown in FIG. 3.

In some embodiments, the microstructure 238 shown in FIG. 2 is disposed on the inner pipe wall of the heat pipe 330 shown in FIG. 3. In this way, not only the heat dissipation efficiency of the speaker module 120 is improved, but also noise generated by the air flow flowing in the heat pipe 330 is reduced.

Figure 4:
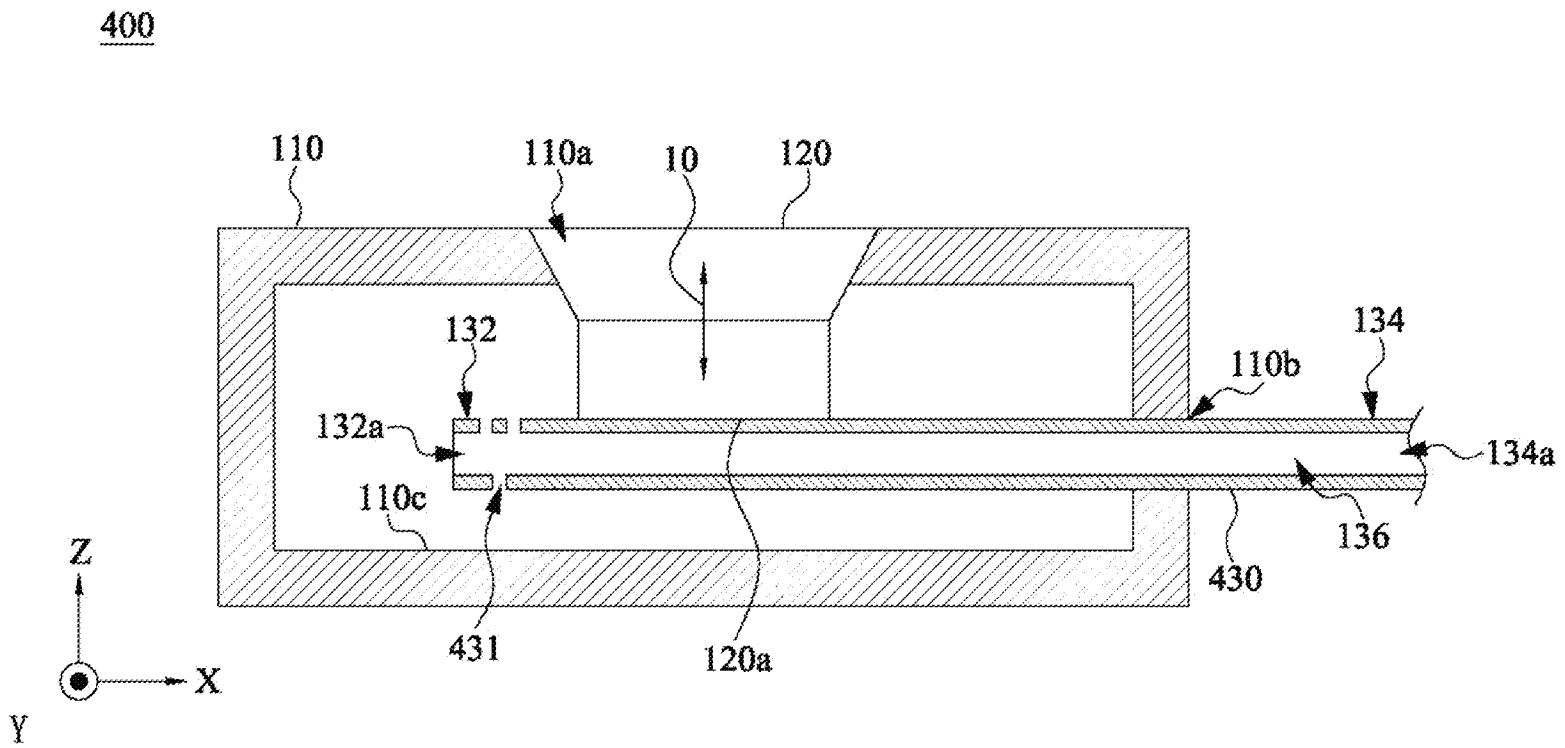
FIG. 4 is a cross-sectional view of a speaker according to an embodiment of the disclosure, where a heat pipe includes a hole formed on a pipe wall thereof.

FIG. 4 is a cross-sectional view of a speaker 400 according to another embodiment of the disclosure. As shown in FIG. 4, in this embodiment, the speaker 400 includes a sound box 110, a speaker module 120, and a heat pipe 430. In this embodiment, the sound box 110 and the speaker module 120 are as the same as those in the embodiment shown in FIG. 1. For details, refer to the foregoing related description, and the details will not be described herein again. In this embodiment shown in FIG. 4, the heat pipe 430 further includes a hole 431. The hole 431 is formed on a pipe wall of the heat pipe 430, to connect the outer pipe wall, the inner pipe wall, and the channel 136 of the heat pipe 430. The hole 431 increases the flow rate of the air flow in the channel 136, and increases the heat dissipation of the heat pipe 430, thereby improving the heat dissipation effect of the heat pipe 430 for the speaker module 120.

In practical applications, the size, shape, position, and quantity of the hole 431 are flexibly adjusted according to actual situations, and the disclosure is not limited to that shown in FIG. 4.

In some embodiments, the hole 431 shown in FIG. 4 is disposed on the pipe wall of the heat pipe 330 shown in FIG. 3, to improve the heat dissipation efficiency of the speaker module 120.

Figure 5:
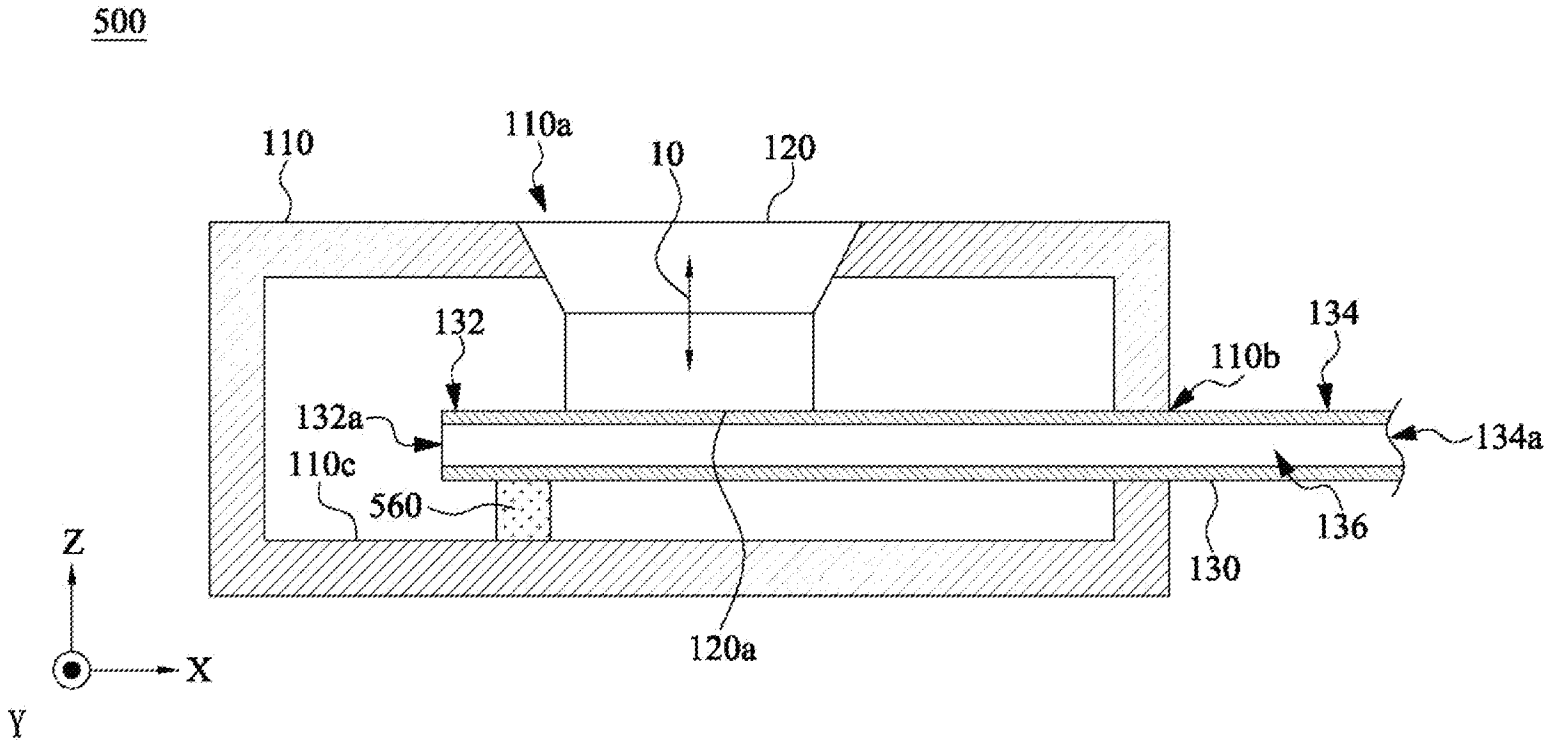
FIG. 5 is a cross-sectional view of a speaker according to an embodiment of the disclosure, where the speaker further includes a support.

FIG. 5 is a cross-sectional view of a speaker 500 according to another embodiment of the disclosure. As shown in FIG. 5, in this embodiment, the speaker 500 includes a sound box 110, a speaker module 120, and a heat pipe 130. In this embodiment, the sound box 110, the speaker module 120, and the heat pipe 130 are as the same as those in the embodiment shown in FIG. 1. For details, refer to the foregoing related description, and the details will not be described herein again. In this embodiment shown in FIG. 1, t the speaker 500 further includes a support 560. The support 560 is connected between the heat pipe 130 and a bottom surface 110*c* of the sound box 110. In an embodiment, the support 560 supports the heat pipe 130 to prevent the heat pipe 130 from shaking greatly with the vibration of the speaker module 120 to cause noise.

In practical, the position and quantity of the support 560 are flexibly adjusted according to actual situations, and the disclosure is not limited to that shown in FIG. 5.

In some embodiments, the support 560 is disposed between the heat pipe 230 shown in FIG. 2 and the bottom surface 110*c* of the sound box 110. In an embodiment, the support 560 is disposed between the heat pipe 330 shown in FIG. 3 and the bottom surface 110*c* of the sound box 110. In other embodiments, the support 560 is disposed between the heat pipe 430 shown in FIG. 4 and the bottom surface 110*c* of the sound box 110. The disclosure is not limited thereto.

Figure 6:
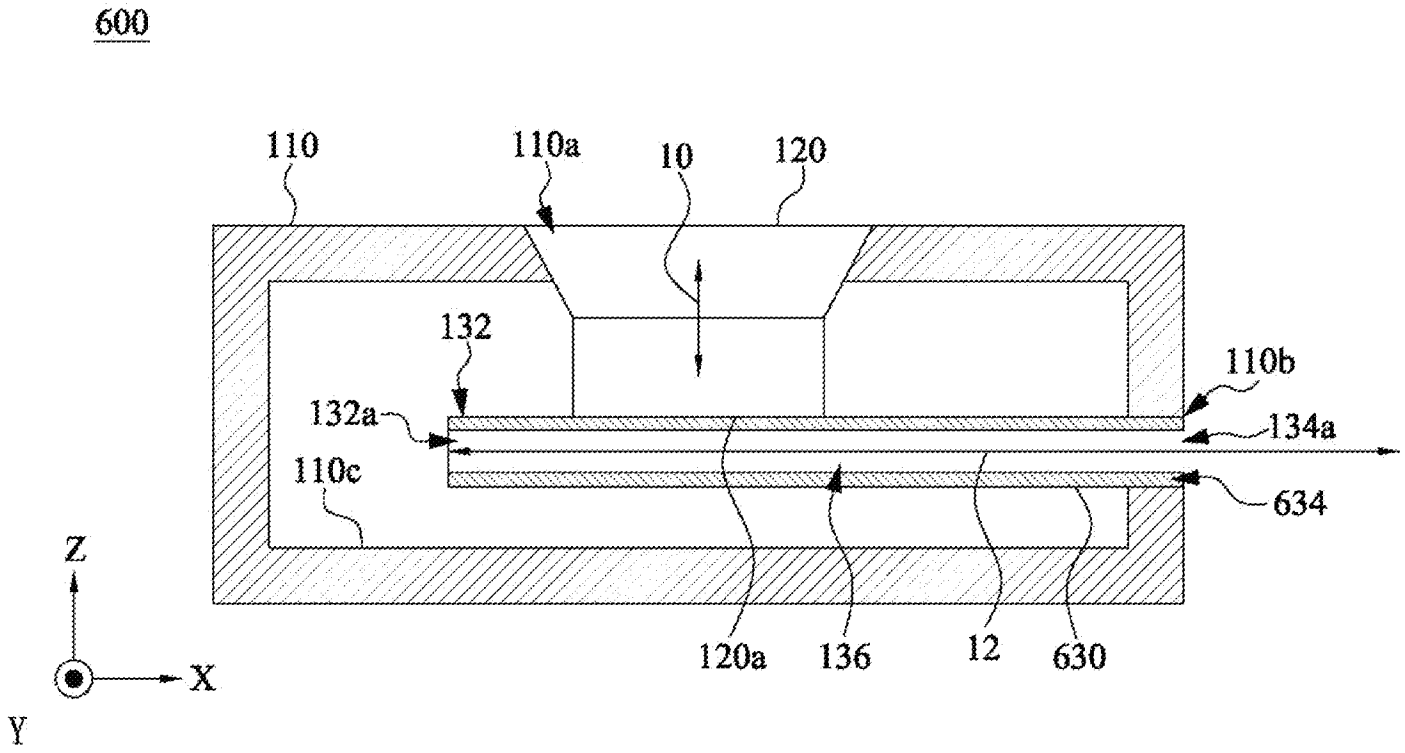
FIG. 6 is a cross-sectional view of a speaker according to an embodiment of the disclosure, where a second end of a heat pipe is located at a second opening.

FIG. 6 is a cross-sectional view of a speaker 600 according to another embodiment of the disclosure. As shown in FIG. 6, in this embodiment, the speaker 600 includes a sound box 110, a speaker module 120, and a heat pipe 630. In this embodiment, the sound box 110 and the speaker module 120 are as the same as those in the embodiment shown in FIG. 1. For details, refer to the foregoing related description, and the details will not be described herein again. As shown in FIG. 6, in an embodiment, the heat pipe 630 extends from the position at which the heat pipe 630 is connected to the second opening 110*b* toward the inner side of the sound box 110, so that a first end 632 of the heat pipe 630 is located in the sound box 110, and a second end 634 of the heat pipe 630 is located at the second opening 110*b* of the sound box 110 and is exposed by the second opening 110*b*. In other words, the second end 134/634 of the heat pipe 130/630 is located at the second opening 110*b* or extends to outside of the sound box 110, and is exposed through the second opening 110*b*. The disclosure is not limited thereto.

In some embodiments, the microstructure 238 shown in FIG. 2 is disposed on an inner pipe wall of the heat pipe 630 in FIG. 6 to reduce noise generated by the air flow in the heat pipe 630.

In some embodiment, the hole 431 shown in FIG. 4 is disposed on a pipe wall of the heat pipe 630 in FIG. 6, to improve the heat dissipation efficiency of the speaker module 120.

In other embodiments, the support 560 shown in FIG. 5 is disposed between the heat pipe 630 and the bottom surface 110*c* of the sound box 110 shown in FIG. 6. The disclosure is not limited thereto.

Figure 7B:
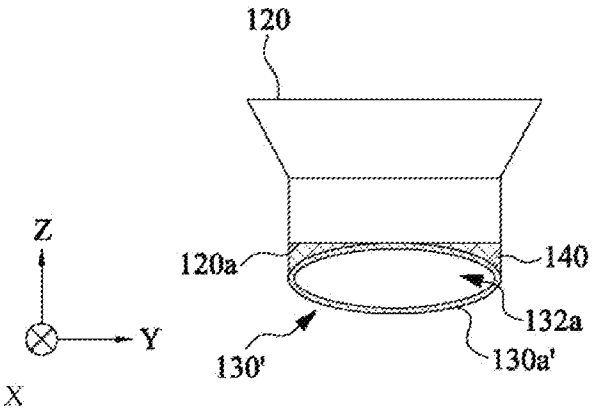
FIG. 7B is a schematic diagram of connection between a speaker module and a heat pipe according to an embodiment of the disclosure, where the heat pipe is an elliptical flat pipe.
Figure 7A:
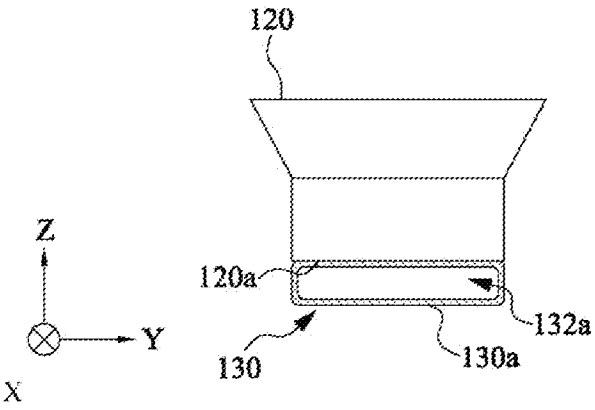
FIG. 7A is a schematic diagram of connection between a speaker module and a heat pipe according to an embodiment of the disclosure.

FIG. 7A to FIG. 7B are schematic diagrams of connections between a speaker module 120 and a heat pipe 130/130'/130" in different embodiments, as viewed from in front of the first pipe opening 132*a* of the heat pipe 130/130'/130" (that is, viewed along the direction X in FIG. 1 to FIG. 6).

As shown in FIG. 7A, in this embodiment, the heat pipe 130 includes a rectangular outer periphery 130*a*. In other words, the heat pipe 130 is a rectangular pipe. Therefore, the heat pipe 130 is in contact with the bottom surface 120*a* of the speaker module 120. In this way, the contact area between the heat pipe 130 and the speaker module 120 is large, thereby improving the heat dissipation efficiency of the speaker module 120.

In some embodiments, the heat pipe 130 is a semicircular pipe, and a surface of heat pipe 130 contacting the bottom surface 120*a* of the speaker module 120 is essentially a plane. In this way, the heat dissipation efficiency of the speaker module 120 is improved.

As shown in FIG. 7B, in this embodiment, the heat pipe 130' is an elliptical flat pipe. Therefore, the heat pipe 130' includes an elliptical outer periphery 130*a*'. When the heat pipe 130' directly contacts the bottom surface 120*a* of the speaker module 120, the elliptical outer periphery 130*a*' of the heat pipe 130 does not completely cling to the bottom surface 120*a* of the speaker module 120. Therefore, there is a gap between the heat pipe 130' and the bottom surface 120*a* of the speaker module 120. The gap between the heat pipe 130' and the bottom surface 120*a* of the speaker module 120 is filled with a thermal conductivity layer 140, so that the heat pipe 130' partially sinks into the thermal conductivity layer 140. The thermal conductivity layer 140 serves as an adhesive between the heat pipe 130' and the speaker module 120, to fixedly connect the heat pipe 130' to the speaker module 120, to prevent the heat pipe 130' from falling off from the speaker module 120 during vibration of the speaker module 120.

In some embodiments, the thermal conductivity layer 140 includes a thermal grease, a heat patch, or heat-dissipation double-sided tape. Therefore, when the thermal conductivity layer 140 is disposed between the heat pipe 130 and the speaker module 120, the thermal conductivity layer 140 serves as an adhesive between the heat pipe 130 and the speaker module 120, facilitates the heat transfer between the heat pipe 130 and the speaker module 120, and increases the actual contact area between the heat pipe 130 and the speaker module 120, thereby improving the heat dissipation efficiency of the speaker module 120.

In some embodiments, the thermal conductivity layer 140 is disposed between the heat pipe 130 shown in FIG. 7A and the bottom surface 120*a* of the speaker module 120. In this embodiment, the thermal conductivity layer 140 is quite thin. Therefore, compared with the heat transfer between the heat pipe 130 and the bottom surface 120*a* of the speaker module 120 that are in direct contact with each other, the thermal conductivity layer 140 has little great influence on the heat transfer between the heat pipe 130 and the speaker module 120. Further, the thermal conductivity layer 140 serves as an adhesive between the heat pipe 130 and the speaker module 120 to prevent the heat pipe 130 from falling off from the speaker module 120 during vibration of the speaker module 120.

Figure 7C:
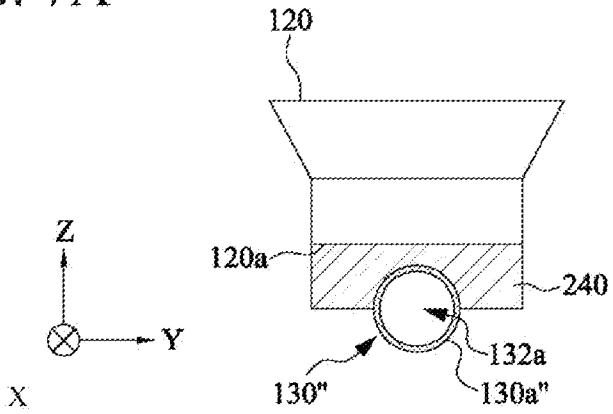
FIG. 7C is a schematic diagram of connection between a speaker module and a heat pipe according to an embodiment of the disclosure, where the heat pipe is a round pipe.

As shown in FIG. 7C, in this embodiment, the heat pipe 130" is a round pipe. Therefore, the heat pipe 130" includes a circular outer periphery 130*a*", and the thermal conductivity layer 240 is a heat dissipation kit. The thermal conductivity layer 240 is disposed between the heat pipe 130" and the bottom surface 120*a* of the speaker module

120, and covers an outer pipe wall of the heat pipe 130". In some embodiments, the thermal conductivity layer 240 partially covers the outer pipe wall of the heat pipe 130". In other embodiments, the thermal conductivity layer 240 surrounds the outer pipe wall of the heat pipe 130". Because of the circular outer periphery 130*a*" of the heat pipe 130", the heat pipe 130" is not in sufficient contact with the bottom surface 120*a* of the speaker module 120, resulting in a small contact area between the heat pipe 130" and the bottom surface 120*a* of the speaker module 120. However, since the thermal conductivity layer 240 is disposed between the heat pipe 130" and the bottom surface 120*a* of the speaker module 120 and covers the outer pipe wall of the heat pipe 130", the actual contact area between the heat pipe 130" and the speaker module 120 is increased. Therefore, the heat pipe 130" also effectively dissipates heat from the speaker module 120.

In some embodiments, the circular outer periphery 130*a*" of the heat pipe 130" directly contacts the bottom surface 120*a* of the speaker module 120, and the thermal conductivity layer 240 covers the pipe wall of the heat pipe 130" without contacting the bottom surface 120*a* of the speaker module 120, and the thermal conductivity layer 240 is connected to the bottom surface 120*a* of the speaker module 120.

As shown in FIG. 7A to FIG. 7C, the connection between the heat pipe and the speaker module is also applied to the speaker shown in FIG. 2 to FIG. 6, and the disclosure is not limited thereto.

It is clearly seen from the foregoing detailed description of embodiments of the disclosure that in the speaker of the disclosure, a hollow heat pipe is fixedly connected to the speaker module, and vibration of the speaker module drives air in the heat pipe to flow to dissipate heat from the heat pipe. Further, the cold heat pipe carries heat away from the speaker module through heat transfer, thereby dissipating heat from the speaker.

Although the disclosure is described with reference to the above embodiments, the embodiments are not intended to limit the disclosure. Any person of ordinary skill in the art may make variations and modifications without departing from the spirit and scope of the disclosure. Therefore, the protection scope of the disclosure should be subject to the appended claims.

What is claimed is:

1. A speaker, comprising:

a sound box, comprising a first opening and a second opening;

a speaker module, hermetically connected to the first opening; and a heat pipe, hermetically connected to the second opening and comprising a first end and a second end, wherein the first end is located in the sound box, and the second end is exposed to the second opening, wherein the speaker module is fixedly connected to at least part of an outer wall of the heat pipe;

wherein the heat pipe comprises a U-shaped structure, the U-shaped structure extends along an outer wall of the speaker module and is in contact with at least two sides of the outer wall of the speaker module.

2. The speaker according to claim 1, further comprising: a thermal conductivity layer, disposed between the heat pipe and the speaker module, wherein the heat pipe is fixedly connected to the speaker module through the thermal conductivity layer.

3. The speaker according to claim 2, wherein the thermal conductivity layer comprises a thermal grease, a heat patch, or a heat dissipation kit.

4. The speaker according to claim 2, wherein the heat pipe at least partially sinks into the thermal conductivity layer.

5. The speaker according to claim 1, further comprising: a support, connected between the heat pipe and the sound box.

* * * * *